United States Patent [19]

Belcham

[11] Patent Number: 4,921,140

[45] Date of Patent: May 1, 1990

[54] BAR GUN WITH SELECTABLE OUTLETS

[75] Inventor: Robert D. J. Belcham, Birmingham, England

[73] Assignee: IMI Cornelius (UK) Limited, Alcester, England

[21] Appl. No.: 242,818

[22] Filed: Sep. 2, 1988

[30] Foreign Application Priority Data

Sep. 5, 1987 [GB] United Kingdom ..... 8720929

[51] Int. Cl.[5] ..... B65D 5/56

[52] U.S. Cl. ..... 222/144.5; 222/129.1; 200/293.1; 200/332.2; 137/625.18

[58] Field of Search ..... 222/129.1, 129.2, 129.4, 222/144.5; 137/625.18, 625.48, 606, 884; 200/293, 332.2, 314, DIG. 47

[56] References Cited

U.S. PATENT DOCUMENTS

| | | | |
|---|---|---|---|
| 2,937,792 | 5/1960 | Firstenberg . | |
| 3,144,967 | 8/1964 | McClain . | |
| 3,168,967 | 2/1965 | Giampa . | |
| 3,241,720 | 3/1966 | Barney . | |
| 3,339,805 | 9/1967 | Wheeler . | |
| 3,703,187 | 11/1972 | Booth . | |
| 3,863,810 | 2/1975 | Hanson . | |
| 3,867,962 | 2/1975 | Gerrard | 222/144.5 |
| 3,930,598 | 1/1976 | Slagle | 222/129.4 |
| 3,979,023 | 9/1976 | Hartley | 222/144.5 |
| 4,162,028 | 7/1979 | Reichenberger . | |
| 4,442,425 | 4/1984 | Eibner | 200/DIG. 47 X |
| 4,489,227 | 12/1984 | Lamarche | 200/DIG. 47 X |
| 4,497,421 | 2/1985 | Schilling . | |
| 4,560,845 | 12/1985 | Takamura et al. | 200/293 X |
| 4,619,378 | 10/1986 | de Man . | |
| 4,670,633 | 6/1987 | Kaiwa et al. | 200/DIG. 47 X |
| 4,673,108 | 6/1987 | de Man | 222/144.5 |
| 4,726,493 | 2/1988 | Wallace et al. | 222/129.1 |
| 4,732,200 | 3/1988 | Valiyee et al. . | |

FOREIGN PATENT DOCUMENTS 1325514 8/1973 United Kingdom .

*Primary Examiner*—Joseph J. Rolla
*Assistant Examiner*—Steve Reiss
*Attorney, Agent, or Firm*—Cushman, Darby & Cushman

[57] ABSTRACT

A bar gun incorporating a flexible stem and a bar head having a plurality of buttons selectively to dispense a plurality of individual beverage flavors in which the bar gun can dispense carbonated or still water wherein there is provided a ring main linking all of the beverage flavors and being connected at one end to the source of carbonated water and at the other to the source of still water with one or more stop valves permitting adjustment of the bar gun so that alternate still or carbonated water can be supplied to a number of beverage outlet points. Further, the buttons are disposed along one or more arcs on the head. These arcs lie underneath the natural transverse movement of the operator's thumb and are centered on the handle side of the head.

14 Claims, 7 Drawing Sheets

BAR GUN WITH SELECTABLE OUTLETS

BACKGROUND OF THE INVENTION

This invention relates to valves and has particular reference to beverage dispense valves known as bar guns.

Bar guns are flexible hoses terminating in a dispense head having a number of buttons thereon. Both still and carbonated water is fed to the head along the flexible stem. A number of syrups or concentrates are also fed along the stem. By selectively pressing the individual buttons on the bar gun head, valves are opened to permit the flow of concentrate and diluent to form the post mix drink.

Such bar guns are described in a number of prior patents.

In U.S. Pat. No. 2,937,792, there is described a soda dispensing device in which the valves for controlling liquids are arranged axially along the length of the handle of the tubes and are controlled indirectly by means of a curved lever.

In U.S. Pat. No. 3,144,967, again the valves are arranged axially along the length of the handle, and in this case are controlled by a series of buttons which act indirectly on the valves by means of angled levers hinged to the head of the bar gun.

In U.S. Pat. No. 3,168,967, the bar gun incorporates a series of valves arranged transverse to the handle, but operated principally by means of levers hinged to the bar gun head.

U.S. Pat. No. 3,241,720 is principally concerned with electrical control circuitry for bar dispensers incorporating membrane switches which are actuated when the soda buttons are pressed.

U.S. Pat. No. 3,339,805 again provides for indirect operation of the valves controlling the flow of beverages by means of levers which when depressed result in lifting of the valves to open the beverage flow paths. The levers are arranged further down the handle than the head of the bar gun.

U.S. Pat. No. 3,703,187 relates to a bar gun of a laminated type in which the laminated layers are sealed together by means of gaskets with rods for disengaging the gasket portions and permitting flow, the rods of the water valves being actuated by push buttons while the rods of the syrup valves are actuated by the pressure of water flowing through the corresponding water valves.

U.S. Pat. No. 3,863,810 describes a bar gun which is of the laminated type and in which the soda under pressure enters the gun at the lower most layer, leaving via the exit point in the layer above. The syrup enters the gun at the upper most layer leaving via the layer below. The body of the head of the gun incorporates a series of '0' rings which seal against a movable piston rod actuated directly by a button under the control of a digit, normally the thumb, of an operator. The piston rod is relieved at portions along its length so that on displacement downwards, the syrup inlet is connected to the syrup outlet and the soda inlet is connected to the soda outlet. The bar gun described in this patent appears to bear the closest similarity to the bar gun of the present invention.

U.S. Pat. No. 4,162,028 is concerned with a beverage dispense system incorporating not only soda mixes, but also spirits as well. The invention is concerned with a dispense system which may readily be computerised.

U.S. Pat. No. 4,497,421 describes a mechanical post-mix bar gun in which the common soda and/or water valve is automatically actuated upon actuation of any of the syrup valves to provide the soda water syrup mixture.

U.S. Pat. No. 4,619,378 is also a laminated type structure intended to be manufactured on a smaller scale than earlier bar guns.

UK patent specification No. 1 325 514 is a convention application based on U.S. patent Ser. No. 97220 and appears to correspond exactly in inventive concept and disclosure to U.S. Pat. No. 3,703,187, the contents of which are noted above.

SUMMARY OF THE INVENTION

By the present invention there is provided a method and a multi-product beverage dispense valve assembly including a plurality of individual product dispense valves each adapted to dispense diluted beverage formed from a concentrate and a diluent, in which the diluent is provided both as carbonated water and still water characterised in that there is provided a ring main within the valve for the diluent adapted to be connected to still water at one end and carbonated water at the other end the ring main interconnecting each of the dispense valves, with stop valve means to stop the through flow of still or carbonated water through the ring main.

The valve assembly may have on one surface a plurality of manually operable buttons to control the flow of diluent and concentrate. The buttons may be disposed in a regular array. There may be provided one or more stop valves to interrupt the ring main circulating diluent around the valve members controlled by the buttons. There may be two stop valves which may be opened or closed as desired. The stop valves may be located between the second and the third buttons counting from one end of the ring main and between the first and second or the third and fourth buttons counting from the other end.

The present invention also provides a bar gun of a general 'T' shape when seen in plan view and having buttons for the direct operation of valves to control the flow of beverages, the buttons being disposed on the cross bar of the 'T' and the leg of the 'T' being a gripping handle.

The buttons are preferably disposed along one or more arcs on the cross bar of the 'T', the arms lying underneath the natural movement of an operator's thumb and being centred on the handle side of the head. There may be two arcs.

The present invention further envisages such a bar gun being formed of a plurality of laminations, the laminations incorporating grooves and orifices so as to define flow paths for liquid flow therethrough and cylinders to contain piston rods and seals to control the flow of beverages through the bar gun.

The present invention further envisages a bar gun for dispensing a plurality of beverages, the bar gun being formed of a plurality of laminations, passageways for liquids being formed in and through the laminations, the gun having a plurality of buttons on an exterior surface, each button serving to control the flow of an individual beverage, and in the case of flavoured beverages each button controlling both the flow of beverage concentrate and diluent, the buttons operating to push a piston rod extending through two or more laminations, the movement of the piston rod opening passageways for diluent and concentrate, the piston rod carrying a plurality of 'O' rings which form the seals between chambers defined in and between the laminations.

There may be four chambers at four levels through the bar gun, the 'O' rings being positioned on the piston such that in the rest position with the button in the fully exposed condition, each chamber is isolated from the chambers above and/or below it, and with the button in the depressed condition, the upper most chamber adjacent the button is fluidly connected to the chamber immediately below it and the lower most chamber is fluidly connected to the chamber immediately above it. The lower most chamber may be adapted to be connected to pressurised diluent and the chamber adjacent the upper most layer may be adapted to be connected to a pressurised concentrate. The piston rod may extend below the lower most chamber into a bore having a smaller diameter than the main portion of the piston rod, the piston rod being sealingly movable in the bore and the underside of the piston rod being exposed to atmospheric pressure. There may be provided a spring to urge the button into the fully exposed position to cut off the flow of beverage.

The present invention further provides a method of dispensing any one of a plurality of different beverages mixed from at least two liquids from the group of still water, carbonated water, and a plurality of syrups, comprising the steps of Connecting a continuous diluent ring main to a plurality of serially arranged diluent dispensing valves;

Connecting a source of syrup to at least some of said valves;

Connecting one inlet end of the main ring to a source of carbonated water;

Connecting a second inlet end of the main ring to a source of still water; and

Selectively obstructing the main ring in between a selected adjacent pair of said valves so that all said valves to a first side of the obstruction dispense carbonated water and all said valves to a second side of the obstruction dispense still water.

BRIEF DESCRIPTION OF THE DRAWINGS

By way of example, embodiments of the present invention will now be described with reference to the accompanying drawings of which

DESCRIPTION OF THE PREFERRED EMBODIMENTS

Figure 1:
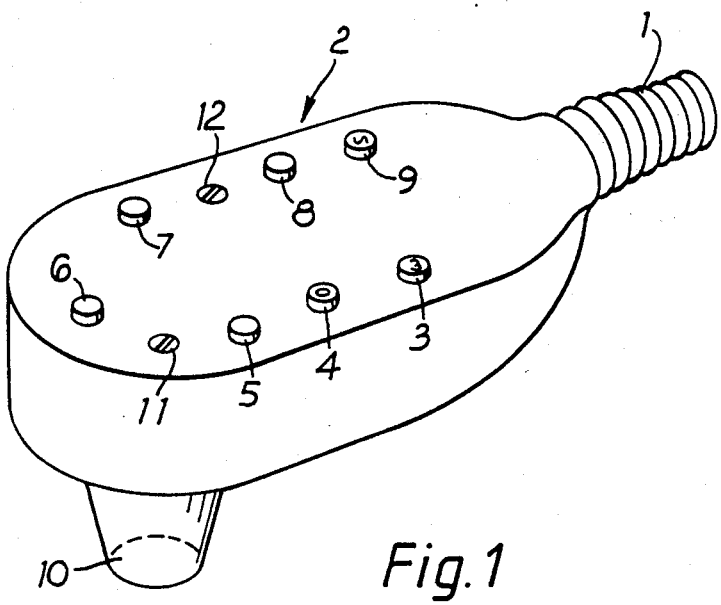
FIG. 1 is a perspective view of a bar gun head.

FIG. 1 shows a bar gun including a flexible stem 1 containing a number of pipes to lead still and carbonated water to a head generally illustrated by 2. Also passing through the stem 1 are concentrate lines.

A series of buttons 3, 4, 5, 6, 7, 8 and 9 control valves of a conventional spool form within the gun head which valves open both beverage and diluent lines so that both concentrate and diluent passes out through nozzle 10 in a conventional manner.

Normally the diluent lines are led to discreet buttons such as still water to buttons 3, 4 and 5 and carbonated water to buttons 6–9. In the invention, however, a ring main is provided for the diluent running in sequence from one end, to the valve controlled by button 3, then on to 4, on to 5 and round to 9 to the other end connection. Stop valves 11 and 12 are provided which may be rotated to close or open the ring main at those positions at will. The stop valves are not intended to be normally adjusted by the operator and are preferably positioned asymmetrically in the ring main and with respect to the valves operated by the buttons 3 to 9 as is shown.

Figure 2:
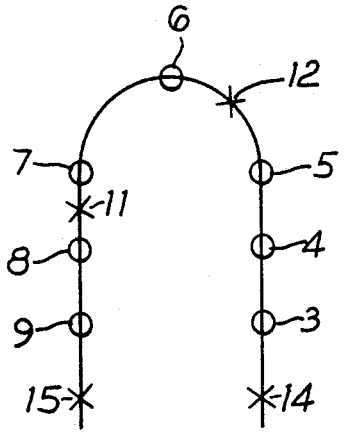
FIG. 2 is a plan view of a ring main and stop valve system

As is shown more clearly in FIG. 2, firstly, assuming manually operable valves 14 and 15 are absent, by closing stop valve 11 and opening stop valve 12, carbonated water is permitted to flow to buttons 9 and 8 and still water is permitted to flow to the valves controlled by buttons 3–7. Buttons 4–8 are provided with cola flavour, tonic flavour, lemon, lime and orange respectively. Thus, buttons 3 and 9 always dispense carbonated or still water. Buttons 4 and 5 always dispense carbonated beverages whereas buttons 6 and 7 may dispense still or carbonated beverages as required depending on the setting of stop valves 12 and 13 and button 8 always dispenses a still beverage.

By reversing the connection of still and carbonated waters it is possible to reverse the number of carbonated beverages to still beverages which can be dispensed because of the asymmetry previously described.

It will also be appreciated that by providing further stop valves at positions 14 and 15 and either opening stop valves 11 and 12 or omitting them, all of the buttons may dispense either carbonated or still beverages.

To prevent water by-passing the closed stop valve and carbonated water entering the plain water line, or vice versa, one-way valves may be provided at the entrance to each end of the ring main.

Figure 3:
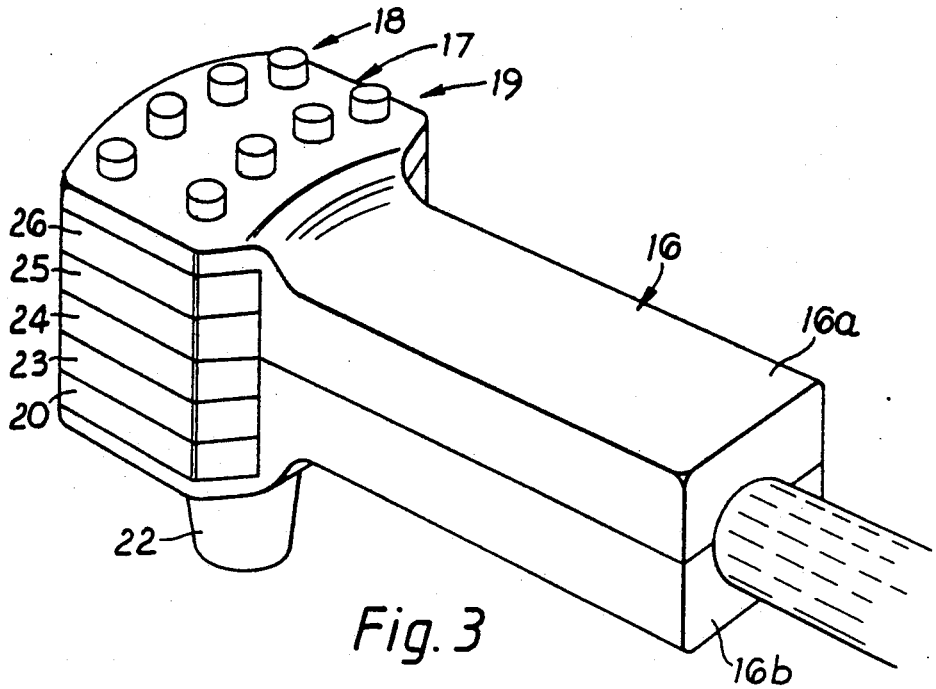
FIG. 3 is a perspective view of a further embodiment of the invention, showing in an exaggerated manner, how the buttons lie along one or more arcs.

Referring to FIGS. 3–11, these show in perspective, sectional, plan and laminate view a second embodiment of the invention. The bar gun illustrated in perspective view in FIG. 3 is of generally 'T' shape having a handle 16 formed of an upper moulding **16*a* and a lower moulding 16*b* and a head 17. The head is provided with two rows of buttons 18, 19 which are arranged in a generally arcuate shape so positioned that an operator holding the handle 16 would find the rows IS and 19** lying generally under the arcuate movement of his or her thumb. The bar gun is formed of five laminations together with a head cover and a nozzle cover.

Figure 4:
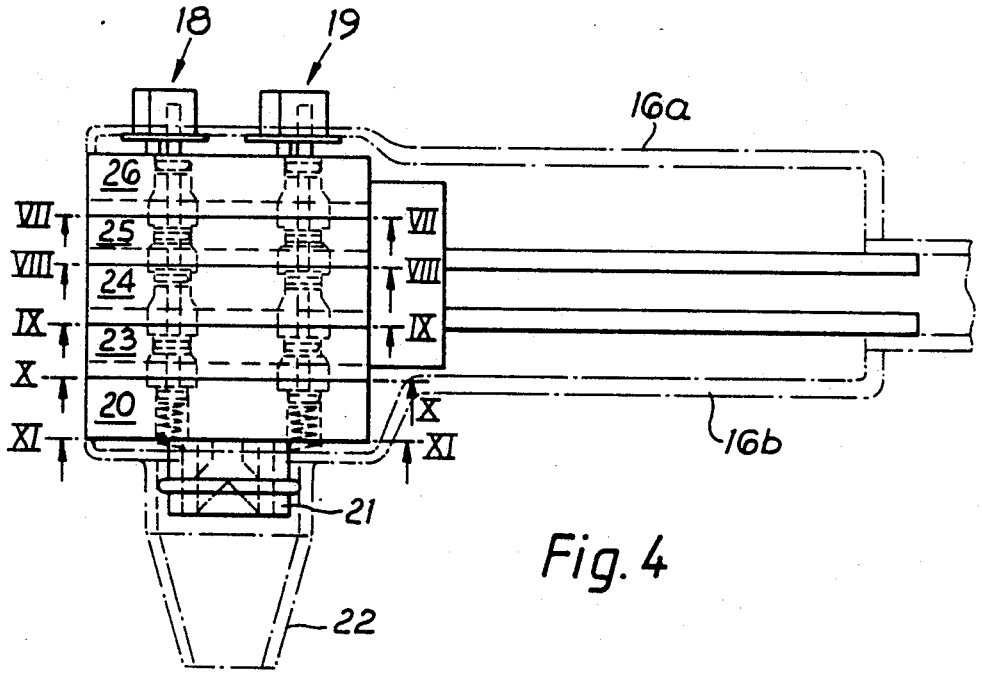
FIG. 4 is a side view of the embodiment of FIG. 3 with the interior detail in dotted lines and the cover plate and nozzle cover in chain dotted lines.
Figure 3A:
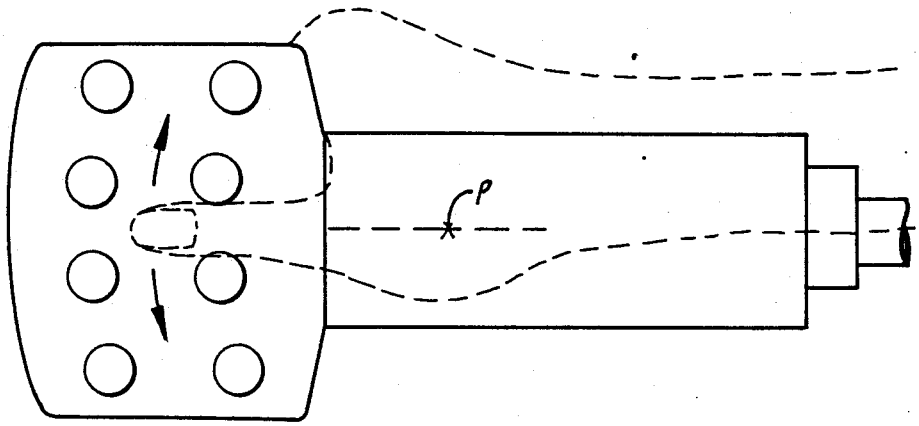
FIG. 3A is similar to FIG. 3 showing an operator's hand holding the bar gun, and showing how the arcs lie along the natural transverse movement of the operators thumb.
Figure 5:
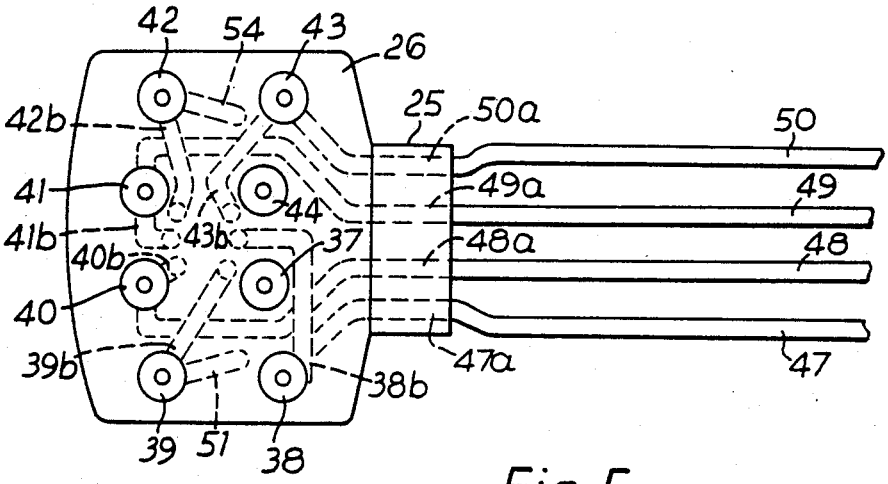
FIG. 5 is a plan of FIG. 4 showing ducts in laminations 1 and 2.
Figure 6:
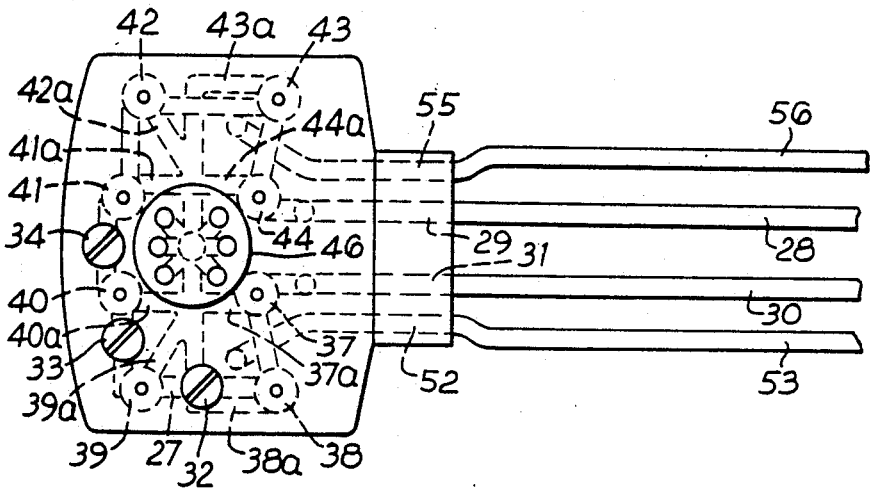
FIG. 6 is an underneath view of FIG. 4 showing the ducts in laminations 3, 4 and 5.
Figure 7:
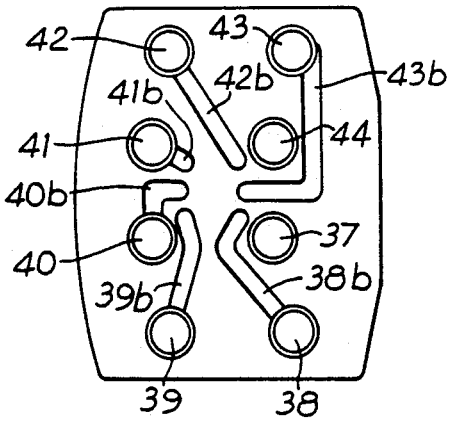
FIG. 7 is a plan view of lamination 1.
Figure 8:
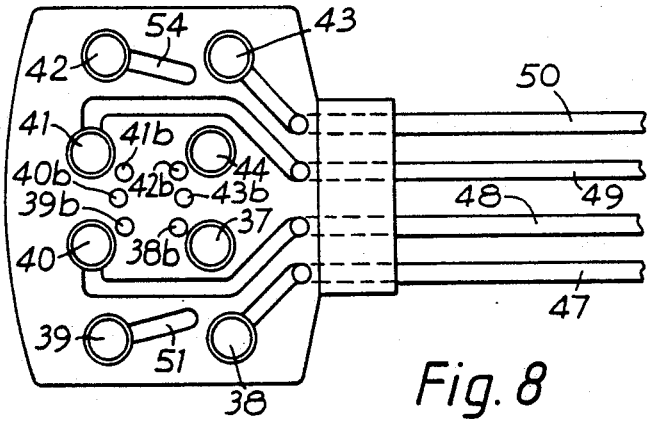
FIG. 8 is a plan view of lamination 2.
Figure 9:
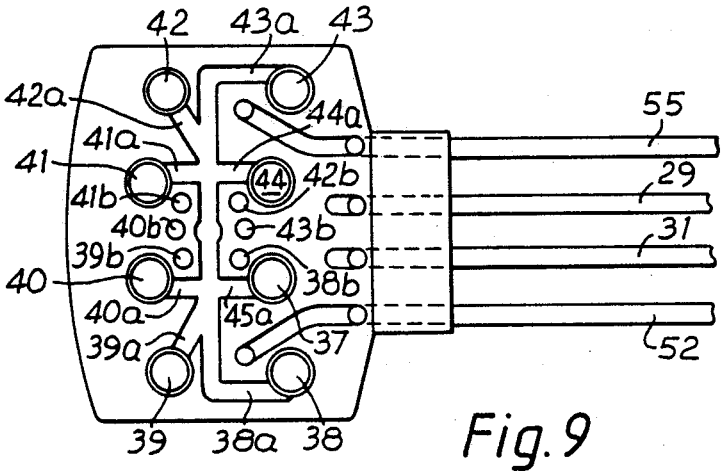
FIG. 9 is a plan view of lamination 3.
Figure 10:
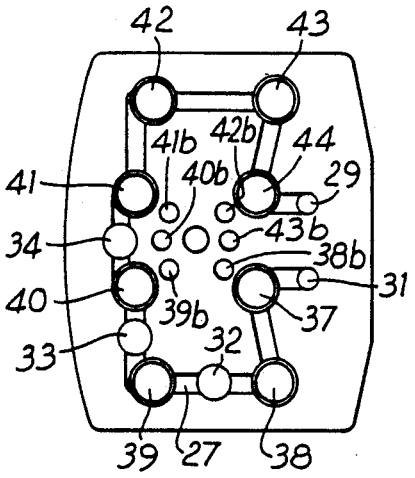
FIG. 10 is a plan view of lamination 4.
Figure 11:
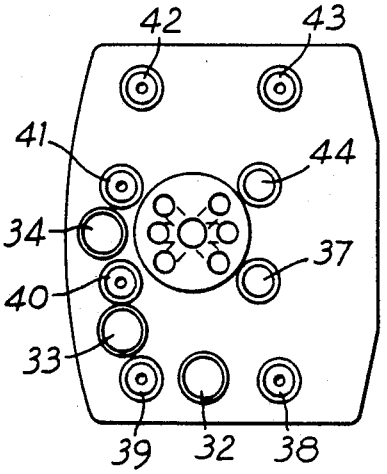
FIG. 11 is a plan view of lamination 5.

The laminations are shown more clearly in FIG. 4 in which the lower lamination 20, also shown in FIG. 11, has located thereon a nozzle member 21 and an external nozzle 22. Bonded to the lamination 20 is a further laminate 23 shown in FIG. 10. A yet further lamination 24 is bonded to lamination 23, and the lamination 24 is shown in more detail in FIG. 9. Lamination 25 is shown in more detail in FIG. 8 and lamination 26 is shown in more detail in FIG. 7. The laminate structure is preferred in that it enables the flow paths for the various fluids flowing through the block to be easily produced. FIG. 5 shows the syrup ducts formed in and between the laminations illustrated in FIGS. 7 and S. FIG. 6 shows the water ducts formed in and between the laminations illustrated in FIGS. 9, 10 and 11.

Referring to FIG. 6 the ducts shown therein are essentially the ducts for the diluent. An essential feature of FIG. 6 is the ring duct 27 connected at one end to line 28 via duct 29 and at the other end to line 30 via duct 31. It can be seen that the lines 30 and 28 are effectively interconnected by means of the ring duct 27. The ring duct is however interruptable at points 32, 33, 34 by means of stop valves which essentially comprise 'O' ring sealed screws which can squash a rubber bung into the duct to stop off the duct where required. Where the screws are not required to stop off the duct, the rubber bung is not incorporated into the bar gun and the 'O' ring seal simply prevents egress of water from the ring main to the outside. As can be seen in FIG. 6, locations 37 and 38 are always connected to duct 30. It may be supposed that duct 30 is connected to plain or sweet water and duct 28 is connected to carbonated or soda water. Obviously, the water connections could be reversed if required. It can be seen therefore that locations 37 and 38 which are connected to dispense buttons and are associated with dispense buttons in the manner set forth below, when operated will always dispense still water. Locations 39, 40, 41, 42, 43 and 44 will always dispense carbonated water if stop valve 32 is closed and valves 33 and 34 are open. Obviously, if stop valve 33 is closed and valve 32 is open, as would be valve 34, then locations 37, 38 and 39 would dispense still drinks and locations 40, 41, 42, 43 and 44 would dispense carbonated drinks.

Similarly, by opening valves 32 and 33 and closing valve 34 there may be provided four still drinks and four carbonated drinks. The locations 37–44 correspond to the valve points operated by the push buttons illustrated in rows 18 and 19 and opening the valve 37 would cause water to flow along dotted line 37*a* to central dispense nozzle 46. Similarly, opening any one of the other locations will result in water, either still or carbonated flowing to the central nozzle via its appropriate duct or interlinked duct.

Referring to FIG. 5 it can be seen that the locations 37 and 44 are not connected to syrup lines or concentrate lines, whereas location 38 is connected to line 47 via duct 47*a*, location 40 is connected to line 48 via duct 48*a*; location 41 is connected to line 49 via duct 49*a* and location 43 is connected to line 50 via duct 50*a*. Location 39 is connected via interlaminate duct 51 and interlaminate duct 52 to line 53 and location 42 is connected via interlaminate duct 54 and interlaminate duct 55 to line 56. Each of the locations 37–44 have ducts 37*a*–44*a* connecting the water flow paths to the central nozzle as shown. It will be seen that locations 37 and 44 are not connected to any syrup or concentrate line. These correspond to the buttons which dispense plain, still or soda water and plain carbonated or soda water without any syrup. The lamination layers shown in FIGS. 7 to 11 show the location and direction of the concentrate ducts 38*b* to 43*b* which feed to the nozzle 21, 22, of the bar gun.

Figure 12:
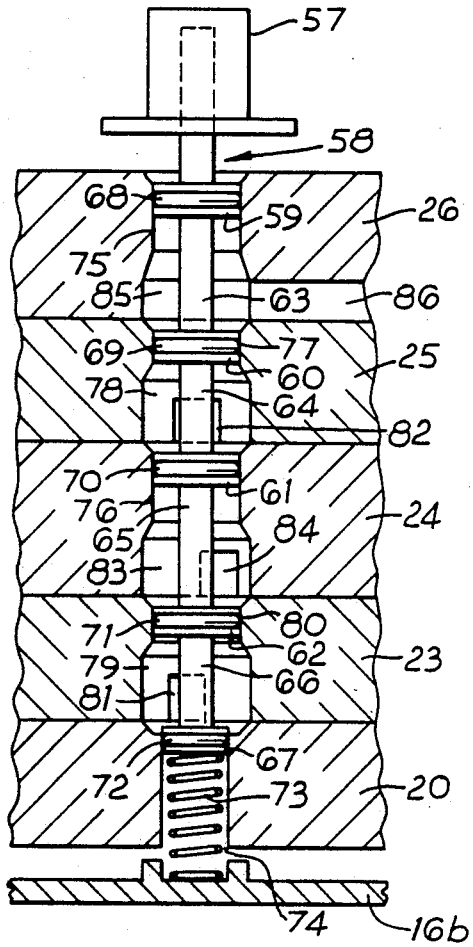
FIG. 12 is a cross sectional view of one piston assembly of the present invention.

The operation of the bar gun is by actuation of the push buttons in rows 18 and 19 and is more clearly understood with reference to FIG. 12. Each push button such as push button 57 displaces a piston rod, generally indicated by 58, downwardly. The piston rod has four lands 59, 60, 61, 62 of the principal diameter of the rod with relieved portions 63 interconnecting lands 59 and 60, relieved portion 64 interconnecting lands 60 and 61, relieved portion 65 interconnecting lands 61 and 62, and relieved portion 66 interconnecting bottom land 62 with a reduced diameter portion or land 67. Each of lands 59 to 62 has an annular groove in which is fitted an 'O' ring 68, 69, 70, 71, and land 67 has an annular groove in which is fitted a smaller diameter 'O' ring 72 so that all of the 'O' rings 68–72 move with the piston. Below the reduced diameter portion 67 there is a return spring 73 and the bottom of the reduced diameter portion 67 is exposed to atmospheric pressure through aperture 74. The bottom of spring 73 is retained by lower moulding 16*b*. In operation of the bar gun, the depression of button 57 results in movement of the entire piston rod downwardly, but it will be noted that lands 59 and 61 always move within cylindrical portions 75 and 76 and do not move so as to permit the passage of liquid past the piston. However, land 60 moves so that 'O' ring 69 is clear of bore 77 and moves into chamber 78. Similarly, land 62 moves into chamber 79 so that the 'O' ring 71 is clear of bore 80. With the piston shown in the exposed or fully "up" position illustrated in FIG. 12, the chamber 79 is connected to pressurised water via duct 81, but the water cannot escape from chamber 79 because it is retained by 'O' rings 71 and 72. Similarly, chamber 78 is exposed to pressurised syrup via duct 82. Chambers 83 to 85 are at atmospheric pressure being connected to atmosphere at the nozzle. When the piston is depressed however, chamber 79 is interconnected to chamber 83 and pressurised water can pass from chamber 83 through duct 84 to the nozzle 21. Chamber 85 is similarly connected to chamber 78, and pressurised syrup or concentrate can also pass from chamber 78 into chamber 85 and from there through duct 86 to the nozzle 21. The syrup or concentrate and the water mix within the nozzle and are dispensed directly into a glass or other receptacle below the nozzle.

By providing the 'O' rings on the piston rod, the manufacture and assembly of the bar gun is more easily arranged than by providing them within the body of the bar gun, as is shown, for example, in U.S. Pat. No. 3 863 810. However, with the arrangement illustrated in FIG. 12, the effective diameter of the piston rod acted on by the pressurised water is the entire cross sectional area of the piston land 62 at the extremities of the diameter of the 'O' ring 71. There is a danger if the pressure of water in chamber 79 is very high, that this pressure acting on the button 57 would make it difficult for the operator to depress the button. This pressure is, however, neatly counterbalanced in the invention by the lower reduced diameter portion 67 of the piston rod which is acted on by the pressure of water within chamber 79, such that the net force acting on piston rod 58 is given by the equation $$[P_c(L_{62}-L_{60})]-[P_c(L_{67}-L_{60})]+S_{73}$$

where $P_c$ is the pressure within chamber 79, $L_{62}$ is the cross sectional area of land 62, $L_{66}$ is the cross sectional area of rod 66, $L_{67}$ is the cross sectional area of land 67 and $S_{73}$ is the force exerted by return spring 73.

By providing the lower portion of piston 58 exposed to the effective pressure of the water in chamber 79, the desired pressure balance can therefore be obtained to reduce the force required t displace button 57. It is preferred, however, that the cross sectional area of 67 should be less than the cross sectional area of 62 so that there is always a net force tending to close off the valve even if spring 73 fails for some reason.

It will be noted that in the event of partial failure of any one 'O' ring in the system, the design of flow paths is such that the bar gun is still usable, provided the 'O' ring has not failed completely. Thus, the partial failure of 'O' ring 72 would simply result in weepage of water through the hole 74 in the bottom of the bar gun. Partial failure of 'O' ring 71 would result in weepage of water through the nozzle. Partial failure of 'O' ring 70 would result in weepage of concentrate through the nozzle, and partial failure of 'O' ring 69 would also result in weepage of concentrate through the nozzle. Failure of 'O' ring 68 would be of little consequence in that the pressure within chamber 85 is zero in the rest condition as duct 86 is open to atmosphere at its other end. It should be noted that if the pressurised syrup were fed in through duct 86 and out through duct 82, 'O' ring 68 would be sealing concentrate at pressure to atmosphere and failure of this 'O' ring would result in weepage of syrup onto the surface of the bar gun and subsequently the gun would become sticky and unusable. Obviously, any 'O' ring failure should be dealt with as soon as possible, but the gun would be operable on an imperfect usage basis until the repair could be effected, whereas with prior art systems in which the syrup is introduced at the upper most level under pressure, failure of one 'O' ring can lead to the gun being unusable.

Figure 13:
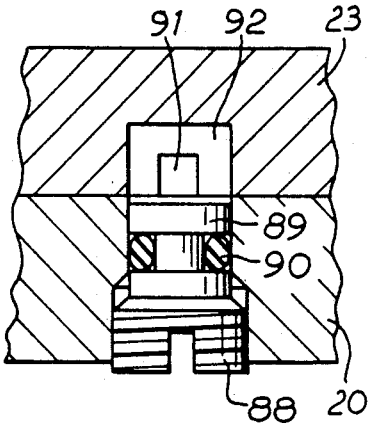
FIG. 13 is a cross sectional view of one stop valve.
Figure 14:
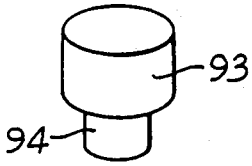
FIG. 14 is a perspective view of a stop valve bung.

Referring to FIG. 13, this shows the valve stop member such as stop member 32. Essentially, there is provided a grub screw 88 having a cylindrical extension 89 incorporating a sealing 'O' ring 90. This grub screw when shown as illustrated in FIG. 13, can be screwed fully closed without blocking duct 91. However, by inserting a rubber bung into the space 92 and squeezing up the bung by means of the grub screw, duct 91 can be sealed simply. Any suitable material may be used for the rubber bung such as a neoprene rubber or a very soft food grade plastics material. A suitable bung is shown in perspective view in FIG. 14 which illustrates a larger diameter head portion 93 which blocks duct 92 and a smaller diameter portion 94 which is integral with portion 93 and which permits the bung to be gripped for removal to open any one or more valves 32, 33 and 34.

If required, the buttons can be illuminated via a fibre optic line which is led along a flexible conduit from a source of light at one end to edge illuminate the buttons.

The laminations may be made of any suitable material, such as polymethyl methacrylate, and the laminations may be banded togather with methylene dichloride.

I claim:

1. A bar gun for dispensing a plurality of beverages, the bar gun being formed of a plurality of laminations, passageways for liquids being formed in and through the laminations, the gun having a plurality of buttons on an exterior surface, each button serving to control the flow of an individual beverage, and in the case of flavoured beverages each button controlling both the flow of beverage concentrate and diluent, the buttons operating to push a piston rod extending through two or more laminations, the movement of the piston rod opening passageways for diluent and concentrate, the piston rod carrying a plurality of 'O' rings which form the seals between chambers defined in and between the laminations;

there being four chambers at four levels through the bar gun, the 'O' rings being positioned on the piston such that in the rest position with each respective said button in a fully exposed condition, each chamber associated with a respective such button is isolated from each chamber above and/or below such chamber and associated with such button, and with such button in a depressed condition the uppermost chamber associated with such button and located adjacent such button is fluidly connected to the respective said chamber immediately below it, and the lowermost respective said chamber is fluidly connected to the respective said chamber immediately above it.

2. A bar gun as claimed in claim 1 in which each respective lower most chamber is adapted to be connected to pressurised diluent, and each respective chamber adjacent the uppermost layer is adapted to be connected to pressurised concentrate.

3. A bar gun as claimed in claim 2 in which each piston rod extends below the respective lower most chamber into a bore having a smaller diameter than that of a main portion of the respective said piston rod, the respective said piston rod being sealingly movable in the respective said bore, and each piston rod having an underside which is exposed to atmospheric pressure.

4. A bar gun as claimed in claim 3 in which there is provided a respective spring to urge each button into the fully exposed position to cut off the flow of beverage.

5. A multi-product beverage dispense valve assembly including a plurality of individual product dispense valves each adapted to dispense diluted beverage formed from a concentrate and a diluent, in which the diluent is provided both as carbonated water and still water characterised in that there is provided a ring main within the valve for the diluent adapted to be connected to still water at one end and carbonated water at the other end the ring main interconnecting each of the dispense valves, with valve means to control the flow of water through the ring main.

6. An assembly as claimed in claim 5 having on one surface a plurality of manually operable buttons to control the flow of diluent and concentrate.

7. An assembly as claimed in claim 5 in which one or more stop valves interrupt the ring main circulating diluent around the valve members controlled by the buttons.

8. A bar gun having a generally "T" shape in plan view and having buttons for the direct operation of valves to control the flow of beverages, the buttons being disposed on the cross bar of the "T" and the leg of the "T" being a gripping handle, the buttons being disposed along one or more arcs on the cross bar of the "T", the arcs lying underneath the natural transverse movement of the operator's thumb and being centered on the handle side of the head.

9. An assembly as claimed in claim 8 in which the buttons are illuminated.

10. An assembly as claimed in claim 9 in which the buttons are illuminated by a fibre-optic light conduit system.

11. A bar gun as claimed in claim 8 in which there are two arcs.

12. A bar gun, comprising:

a dispensing head having a generally "T" shape in plan view, including a transversally extending cross bar joined to a longitudinally-extending leg;

inlet means for the dispensing head through said leg and outlet nozzle means from the dispensing head at one side of the dispensing head;

said inlet means being communicated to said outlet nozzle means via a plurality of respective passageways provided with valves for controlling beverage fluid flow through respective ones of such passageways;

said cross bar, on an opposite side of said head from said one side having a plurality of externally accessible buttons which, when manually activated in use, operate respective ones of said valves for controlling beverage fluid flow to said outlet nozzle means through respective ones of said passageways;

said leg, on said opposite side of said head constituting a gripping handle to be manually gripped, in use, by a hand of an operator;

said buttons being disposed in at least one arc extending generally transversally of said head on said cross bar, each said arc lying under the path of natural transverse movement of the thumb of the operator's hand and centered, left-to-right, on an imaginary longitudinal centerline of said head.

13. A bar gun for dispensing a plurality of beverages, the bar gun being formed of a plurality of laminations, passageways for liquids being formed in and through the laminations, the gun having a plurality of buttons on an exterior surface, each button serving to control the flow of an individual beverage, and in the case of flavoured beverages each button controlling both the flow of beverage concentrate and diluent, the buttons each operating to push a respective piston rod extending through two or more of said laminations, the movement of the piston rod opening passageways for diluent and concentrate, each piston rod carrying a plurality of 'O' rings which form seals between chambers defined in and between the laminations;

said chambers being defined at a plurality of levels through the bar gun, the 'O' rings being positioned on the piston such that in the rest position with each respective said button in a fully exposed condition, each chamber associated with a respective such button is isolated from each chamber above and/or below such chamber and associated with such button, and with such button in a depressed condition the uppermost chamber associated with such button and located adjacent such button is fluidly connected to the respective said chamber immediately below it, and the lowermost respective said chamber is fluidly connected to the respective said chamber immediately above it, the respective said lowermost chamber being adapted to be connected to pressurised diluent, and the respective said chamber adjacent the uppermost layer being adapted to be connected to pressurised concentrate;

each piston rod extending below the respective said lowermost chamber into a bore having a smaller diameter than that of a main portion of the respective said piston rod, the respective said piston rod being sealingly movable in the respective said bore, and each piston rod having an underside which is exposed to atmospheric pressure.

14. A method of dispensing any one of a plurality of different beverages mixed from at least two liquids from the group of still water, carbonated water, and a plurality of syrups, comprising the steps of connecting a continuous diluent ring main to a plurality of serially arranged diluent dispensing valves;

connecting a source of syrup to at least some of said valves;

connecting one inlet end of the main ring to a source of carbonated water;

connecting a second inlet end of the main ring to a source of still water; and selectively obstructing the main ring in between a selected adjacent pair of said valves so that all said valves to a first side of the obstruction dispense carbonated water and all said valves to a second side of the obstruction dispense still water.

* * * * *